US005697604A

United States Patent [19]

Tanaka

[11] Patent Number: 5,697,604

[45] Date of Patent: Dec. 16, 1997

[54] SHEET SUPPLY APPARATUS

[75] Inventor: Akinori Tanaka, Yokohama, Japan

[73] Assignee: Canon Kabushiki Kaisha, Tokyo, Japan

[21] Appl. No.: 805,557

[22] Filed: Feb. 25, 1997

Related U.S. Application Data

[63] Continuation of Ser. No. 574,076, Dec. 18, 1995, abandoned.

[30] Foreign Application Priority Data

| | | | |
|---|---|---|---|
| Dec. 21, 1994 | [JP] | Japan | 6-318321 |
| May 30, 1995 | [JP] | Japan | 7-131815 |
| Dec. 5, 1995 | [JP] | Japan | 7-316647 |

[51] Int. Cl.[6] ..... B65H 3/52

[52] U.S. Cl. ..... 271/121

[58] Field of Search ..... 271/121, 122, 271/124, 125, 167

[56] References Cited

U.S. PATENT DOCUMENTS

| | | | |
|---|---|---|---|
| 5,044,622 | 9/1991 | Cattin | 271/121 |
| 5,269,505 | 12/1993 | Sardano | 271/121 |

FOREIGN PATENT DOCUMENTS 06239438 8/1994 Japan .

*Primary Examiner*—David H. Bollinger

*Attorney, Agent, or Firm*—Fitzpatrick, Cella, Harper & Scinto

[57] ABSTRACT

The present invention provides a sheet supply apparatus comprising a supply rotary means for feeding a sheet and a friction member which cooperates with the supply rotary means for preventing movement of remaining sheets in a sheet feed direction to thereby permit the separation of the sheet from the remaining sheets. A surface of the friction member with which the sheet is to be contacted has cut-in portions.

27 Claims, 11 Drawing Sheets

SHEET SUPPLY APPARATUS

This application is a continuation of application Ser. No. 08/574,076, filed Dec. 18, 1995, now abandoned.

BACKGROUND OF THE INVENTION

1. Field of the Invention

The present invention relates to a sheet supply apparatus for supplying a sheet such as an original, a recording sheet and the like to an image forming apparatus such as a copying machine, a printer, a facsimile and the like.

2. Related Background Art

In the past, in some image forming apparatuses, there is provided a sheet supply apparatus having a friction member for separating sheets to prevent double feed of sheets. Such a friction member may be a rubber return roller, a rubber separation pad and the like. FIGS. 8A and 8B show examples of a separation mechanism which includes a separation pad as a friction member. In FIGS. 8A and 8B, the separation mechanism comprises a separation pad 100 and a feed roller 101 urged against the separation pad 100 so that sheets fed out by the feed roller 101 are separated one by one between the feed roller and the separation pad 100. A surface of such a friction member with which the sheet is contacted may be left as it is formed, or may be subjected to polishing treatment, or may be formed the mixture of the roller material and cork and the like to improve the separation of the sheet.

However, in recent years, in manual sheet supply portions of copying machines, it has been requested that various sheets such as thick sheets, thin sheets, OHP sheets (film sheets), special paper sheets and the like, as well as plain paper sheets should be supplied and separated. Thus, it has been difficult to form the surface of the separation member of the separation mechanism by various working and finishing treatment to adequately match the separation member with various sheets. In particular, regarding the OHP sheet, since the OHP sheet is apt to be closely contacted with the separation member, a conveying force of the feed roller does not overcome the friction force between the sheet and the separation member, thereby causing poor supply of sheet. To avoid this, when the close contact ability of the surface of the friction member is reduced to permit the separation of the OHP sheet, if the plain sheets are desired to separate from each other, the sheets cannot be fully separated to cause the poor separation, thereby generating the double feed of sheets.

Further, in a case where a both-face copying operation is effected in a full-color copying machine, when a sheet to which mold releasing agent (for separating the sheet from a fixing device) was adhered is tried to re-supply to an image forming portion, if the friction member is made of normal rubber, since slip is generated between the sheet and the friction member, the material of the friction member is limited to silicone rubber capable of absorbing silicone oil to maintain a sheet conveying force. As a result, the working or finishing of the surface of the friction member becomes more difficult. In addition, if the friction member is made of silicone rubber, since the OHP sheet and the like will be further apt to be closely contacted with the friction member to further reduce the sheet conveying force, thereby frequently causing the poor conveyance.

To avoid this, in the prior art, the surface of the friction member is rolled by the feed roller or the surface of the friction member is polished by passing the sheet sometimes, thereby preventing the poor separation and/or poor conveyance of the sheet.

Further, as disclosed in the Japanese Patent Laid-open No. 6-239438, there has been proposed a technique in which a protruded ridge and a groove are formed on a surface of a friction member along a direction oriented at a predetermined angle with respect to a sheet conveying direction, thereby providing good separating ability of the friction member for OHP sheets. In this friction member, by appropriately selecting a width and/or an inclination angle of the protruded ridge, even the OHP sheet separating ability of the friction member can be set at optimum to provide the positive sheet separation.

However, in the conventional technique in which the surface of the friction member is rolled by the feed roller, there arose problem that it takes a long time to treat the surface of the friction member and that the conveying and separating ability of the friction member is reduced more or less. Further, there also arose a problem that, if the friction member is left as it is for a long time after the friction member is rolled, the effect of the rolling will be gradually decreased.

Further, although, the close contact between the OHP sheet and the friction member can be prevented by decreasing the contact area between the friction member and the OHP sheet, if do so, there will arise a problem that the double feed of sheets is apt to occur. In addition, although it is considered that contacting pressure (separation pressure) between the friction member and the feed roller is reduced to prevent the close contact between the OHP sheet and the friction member, if do so, there will also arise a problem that the double feed of sheets is apt to occur. That is to say, if the separating ability is increased to prevent the double feed, the close contact force between the OHP sheet and the friction member will also be increased accordingly, with the result that the conveying force of the feed roller cannot overcome the close contact force between the OHP sheet and the friction member, thereby causing the poor conveyance. As such, the improvement in the sheet separating ability and the improvement in the sheet conveying ability are incompatible.

Further, although the above problems may be solved by appropriately adjusting the material and surface feature of the friction member, since there are many kinds of sheets, the materials from which the friction member is used are limited, and, thus, the adjustment is very difficult or the range of the adjustment is relatively narrow, thereby worsening productivity and increasing the manufacturing cost. Further, in the case where the protruded ridge and the groove are formed on the surface of the friction member along the direction oriented at the predetermined angle with respect to the sheet conveying direction, although the OHP sheet can be treated well, regarding the plain paper sheet (particularly, thin sheet), it is feared that a tip end of the sheet is caught by the ridge and/or groove to cause the folding of the sheet or the skew-feed of the sheet, and, thus, the friction member having the protruded ridge and the groove cannot cope with various kinds of sheets.

SUMMARY OF THE INVENTION

It is an object of the present invention to provide a sheet supply apparatus which can positively separate and supply various kinds of different sheets.

To achieve the above object, according to one aspect of the present invention, there is provided a sheet supply apparatus comprising a supply rotary means for feeding a sheet and a friction member to cooperate with the supply rotary means to thereby prevent a movement of remaining sheets in a sheet feed direction to permit the separation of the sheet from the remaining sheets. A surface of the friction member with which the sheet is to be contacted has a cut-in portion.

Preferably, the friction member comprises a separation pad urged against the supply rotary means to prevent the movement of the remaining sheets in the sheet feed direction and the separation pad has the cut-in portion.

Further, the friction member may comprise a retard roller urged against the supply rotary means and rotated in a direction opposite to the sheet feed direction to prevent the movement of the remaining sheets in the sheet feed direction, and the cut-in portion may be provided with an outer peripheral surface of the retard roller.

According to another aspect of the present invention, there is provided a sheet supply apparatus comprising a supply rotary means for feeding a sheet and a friction member to cooperate with the supply rotary means to thereby prevent a movement of remaining sheets in a sheet feed direction to permit the separation of the sheet from the remaining sheets. A surface of the friction member with which the sheet is to be contacted is divided into a plurality of sections which are contacted with each other without any gap.

According to a further aspect of the present invention, there is provided a sheet supply apparatus comprising a supply rotary means for feeding a sheet and a friction member to cooperate with the supply rotary means to thereby prevent a movement of remaining sheets in a sheet feed direction to permit the separation of the sheet from the remaining sheets. A surface of the friction member with which the sheet is to be contacted has a cut-in portion inclined at a predetermined angle with respect to the sheet feed direction of the supply rotary means.

DETAILED DESCRIPTION OF THE PREFERRED EMBODIMENTS

The present invention will now be explained in connection with embodiments thereof with reference to the accompanying drawings.

Figure 12:
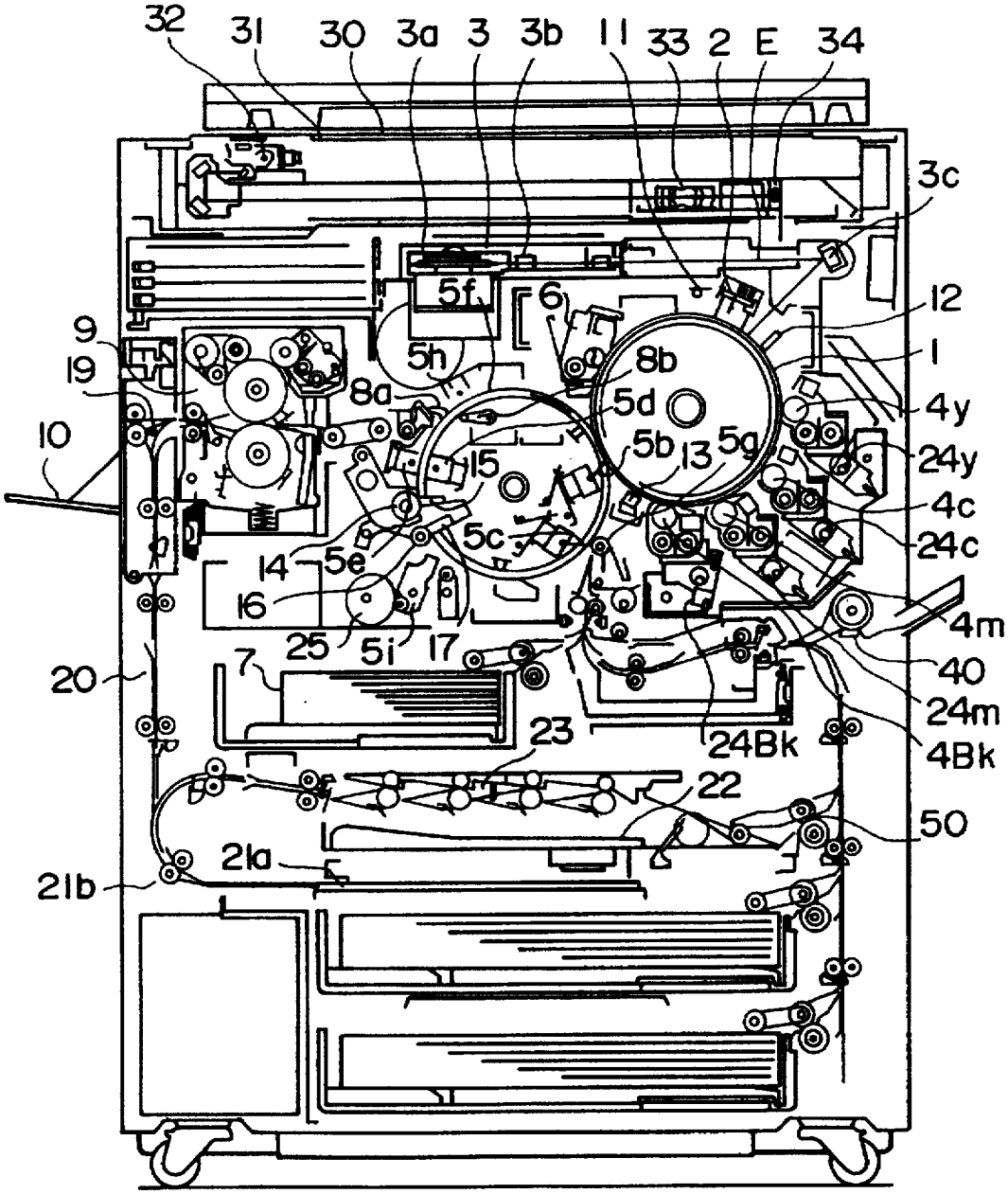
FIG. 12 is a sectional view showing an example of an image forming apparatus having a sheet supply apparatus according to the present invention.
Figure 13:
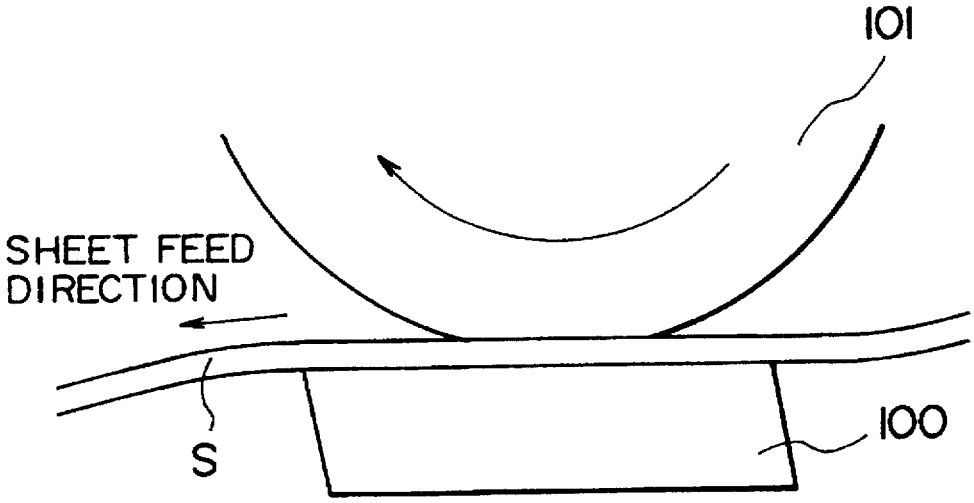
FIG. 13 is a view showing an example of a separation portion of a conventional sheet supply apparatus.

FIG. 12 is a schematic sectional view of a color image forming apparatus according to an embodiment of the present invention, which apparatus comprises an upper digital color image reader portion and a lower digital color image printer portion.

In the reader portion, by exposure-scanning an original 30 rested on an original support glass 31 by light emitted from an exposure lamp 32, a light image reflected from the original 30 is condensed on a full-color sensor 34 by means of a lens 33, thereby providing a color-decomposed image signal. The color-decomposed image signal is sent, through an amplifier circuit (not shown), to a video treatment unit, where the signal is treated. The treated signal is sent to the printer portion.

In the printer portion, a photosensitive drum (image bearing member) 1 can be rotated in a direction shown by the arrow. Around the photosensitive drum 1, there are disposed a pre-exposure lamp 11, a corona charger 2, a laser exposure optical system 3, a potential sensor 12, a developing means including four developing devices **4*y*, 4*c*, 4*m*, and 4B*k* containing different color toners, respectively, a detection means 13 for detecting a light amount on the drum, a transfer device 5, and a cleaning device 6. In the laser exposure optical system 3, the image signal from the reader portion is converted into a light signal in a laser output portion (not shown), and the converted laser light (light signal) is reflected by a polygon mirror 3*a*. The reflected laser light is projected on a surface of the photosensitive drum 1 through a lens 3*b* and a mirror 3*c***.

When image formation is performed in the printer portion, the photosensitive drum 1 is rotated in the direction shown by the arrow. After electricity on the photosensitive drum is removed by the pre-exposure lamp 11, the photosensitive drum 1 is uniformly charged by the charger 2. Then, light images E for decomposed colors are successively illuminated on the photosensitive drum, thereby forming latent images.

Whenever the latent image is formed, a corresponding developing device is operated to develop the latent image formed on the photosensitive drum 1 to form a toner image (having resin as a base component). The developing devices can be selectively brought to a position where the developing device is opposed to the photosensitive drum by corresponding eccentric cams **24*y*, 24*c*, 24*m* and 24B*k*** for each decomposed color.

Further, the toner image formed on the photosensitive drum 1 is transferred onto a sheet supplied from a sheet cassette 7 to a transfer position (where the sheet is opposed to the photosensitive drum 1) by means of a convey system and the transfer device 5. In the illustrated embodiment, the transfer device 5 comprises a transfer drum **5*a*, a transfer charger 5b, an absorb charger 5c and an absorb roller 5g (opposed to each other) for electrostatically absorbing the sheet, an inner charger 5d, and an outer charger 5e. A bearing sheet 5f made of dielectric material is provided to cover a peripheral opening of the transfer drum 5a supported for rotation. The bearing sheet 5f** is formed from a dielectric film such as a polycarbonate film and the like.

As the drum-shaped transfer device (i.e. transfer drum 5a) is rotated, the toner image formed on the photosensitive drum is transferred onto the sheet born on the bearing sheet 5f by means of the transfer charger 5b. In this way, a desired number of color toner images are transferred onto the same sheet born on the bearing sheet 5f, thereby forming a full-color image.

In case of the full-color image formation, after the four color toner images are transferred to the sheet, the sheet is separated from the transfer drum 5a by means of a separation pawl 8a, a separation push-up roller 8b and a separation charger 5h. The separated sheet is sent to a heat roller fixing device and then is discharged out of the image forming apparatus. On the other hand, after the transferring operation, residual toner remaining on the photosensitive drum 1 is removed by the cleaning device 6 for preparation for next image formation.

When images are formed on both surfaces of the sheet, immediately after the sheet is discharged from the fixing device, a convey path switching guide 19 is driven, with the result that the sheet is temporarily introduced into a reverse rotation path 21a through a vertical convey path 20. Then, by rotating a reverse rotation 21b in a reverse direction, the introduced sheet is sent toward an opposite direction with a trailing end thereof (when introduced) going ahead, thereby introducing the sheet onto an intermediate plate 22. Thereafter, an image is formed on the other surface of the sheet in the same manner as mentioned above.

In order to prevent the toner from remaining on the bearing sheet 5f and to prevent oil from adhering to the sheet, the bearing sheet is cleaned by means of a fur brush 14 and a back-up brush 15 which are opposed to each other with the interposition of the bearing sheet 5f, and an oil removing roller 16 and a back-up roller 17 which are opposed to each other with the interposition of the bearing sheet 5f. Such a cleaning operation is performed before or after the image formation, and is always performed if the sheet jam occurs.

Further, in the illustrated embodiment, an eccentric cam 25 is operated at a predetermined timing to drive a cam follower 5i integral with the transfer drum 5a so that a gap between the bearing sheet 5f and the photosensitive drum 1 can be set appropriately. For example, a stand-by condition or a power-off condition, the transfer drum is spaced apart from the photosensitive drum.

Figure 3:
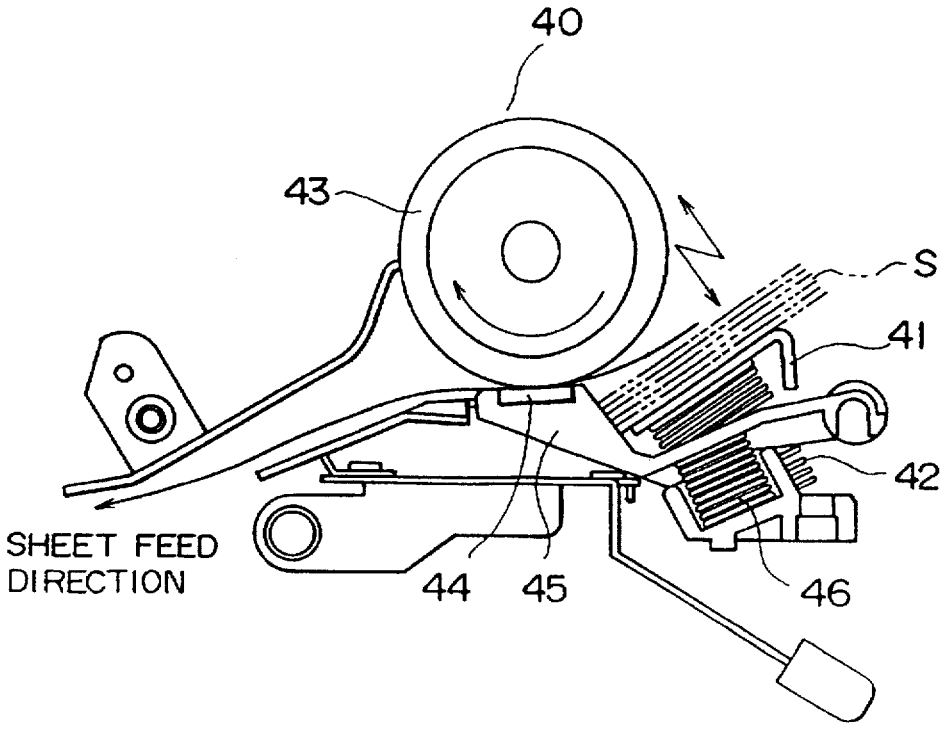
FIG. 3 is a side view showing an entire construction of the first embodiment.

At a side of the color image forming apparatus, there is disposed a sheet supply apparatus (multi sheet supply portion) 40 capable of supplying various kinds of sheets such as a thin sheet, a thick sheet, an OHP sheet and the like. The entire construction of the sheet supply apparatus 40 will now be explained with reference to FIG. 3.

Sheets S are stacked on a lift/lower intermediate plate 41 which is biased upwardly by springs 42. A feed roller (supply rotary member) 43 is disposed above a downstream end of the intermediate plate 41, which feed roller 43 abuts against an upper surface of the sheet stack S rested on the intermediate plate 41 and feeds out the sheet(s) S. Incidentally, the lifting and lowering of the intermediate plate 41 is appropriately controlled by a lift/lower mechanism (not shown) so that the intermediate plate is lifted to urge the upper surface of the sheet stack S against the feed roller 43 when the sheet is fed out.

A friction member (referred to as "separation pad" hereinafter) 44 for preventing the double feed of sheets is urged against the feed roller 43 so that, if two or more sheets S are fed out, the sheets are separated and supplied one by one by means of the separation pad 44. The separation pad 44 is supported by a pad holder 45 for swinging movement and urged toward the feed roller by the feed roller 43 by springs 46 with predetermined separation pressure. The separation pressure and a contact area (separation nip width) between the separation pad 44 and the feed roller 43 are appropriately set in dependence upon material of the sheet to be supplied and a sheet supplying condition.

Figure 1A:
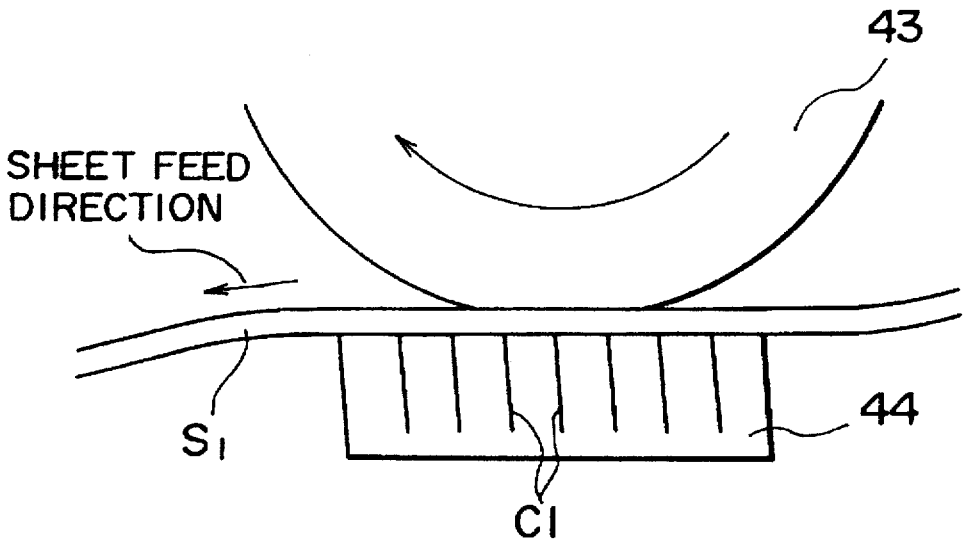
FIGS. 1A and 1B are enlarged views showing a close contact condition between a sheet and a fiction pad used in a sheet supply apparatus according to a first embodiment of the present invention.

Next, the separation pad 44 according to the present invention is fully explained with reference to FIGS. 1A and 1B and 2.

Figure 2:
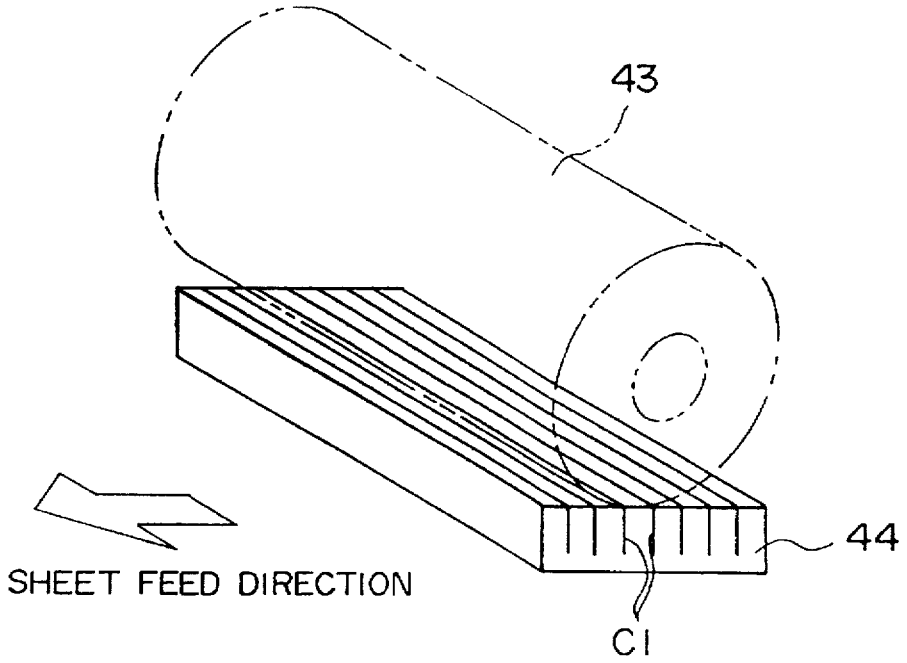
FIG. 2 is a perspective view showing a relation between the friction pad of FIGS. 1A and 1B and feed roller.

As shown in FIG. 2, a surface of the separation pad 44 which faces to the feed roller 43 (i.e. surface with which the sheet S is slidingly contacted) is provided with a plurality of checks or cut-in portions C1 which extend along a direction perpendicular to the sheet feed direction and are disposed side by side along the sheet feed direction. With the arrangement having the cut-in portions C1, the separation pad 44 is divided into a plurality of sections by the cut-in portions C1. When the sheets (such as plain paper sheets) $S_1$ having low close contact feature regarding the surface of the separation pad 44 are separated, as shown in FIG. 1A, although the separation pad 44 is divided into a plurality of sections, since relative deviation between the sections is little or very small, substantially the entire surface of the separation pad is contacted with the sheet, with the result that the separation pad can be operated in the same manner as the conventional separation pads.

Figure 1B:
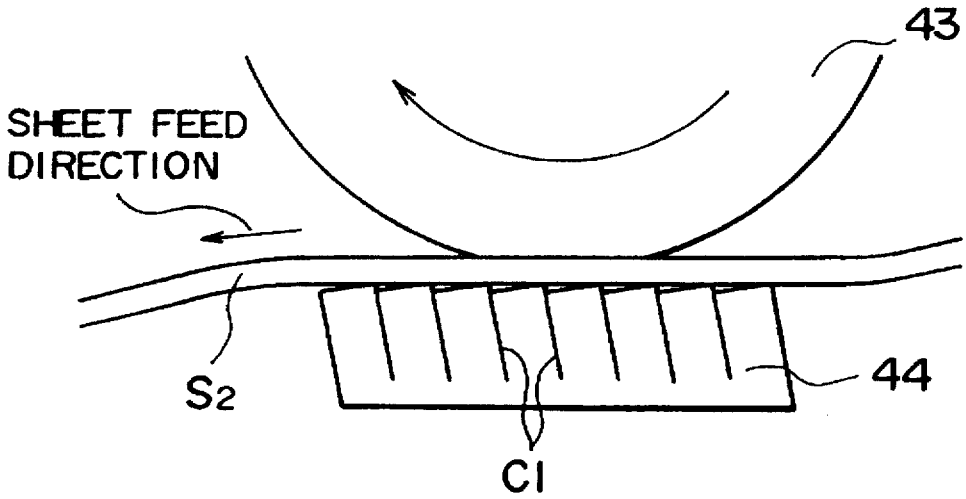

On the other hand, when the sheets (such as OHP sheets) $S_2$ having high close contact feature regarding the surface of the separation pad 44 are separated, as shown in FIG. 1B, since relative deviation between the sections is great, the divided sections are inclined. As a result, small gaps are created between the sheet $S_2$ and the separation pad 44, thereby decreasing the contact area between the sheet $S_2$ and the separation pad 44. Consequently, the friction force between sheet and the separation pad can be reduced in comparison with the case where the entire surface of the separation pad is contacted with the sheet.

In this way, for example in case of the plain paper sheet, as is in the prior art, the entire surface of the separation pad 44 is contacted with the sheet to provide the adequate friction force, thereby achieving positively separating action. On the other hand, in case of the OHP sheet and the like, the contact area between the sheet and the separation pad 44 is reduced to decrease the friction force, thereby weakening a load (in a sheet returning direction) acting on the feed roller 43. As a result, the conveying force of the feed roller 43 can overcome the sheet returning force of the separation pad 44, thereby preventing the sheet from remaining in the separation portion. Accordingly, various sheets having different close contact features can be separated and supplied positively and stably.

Further, in the divided separation pad 44, an inclined amount of each section is changed depending upon the close contact feature of the sheet so that the greater the close contact force the greater the inclined amount. Accordingly, the greater the close contact force the smaller the contact area between the sheet and the separation pad 44, thus decreasing the friction force acting on the sheet. In this way, since the greater the close contact force the smaller the friction force, the optimum separating force can be obtained in dependence upon the close contact feature of the sheet.

Incidentally, in the illustrated embodiment, although an example that the cut-in portions extend in the direction perpendicular to the sheet feed direction was explained, the cut-in portions may be inclined at a predetermined angle with respect to an up-and-down direction or a left-and-right direction. Further, in the multi sheet supply portion, when the plain paper sheet is supplied, the feed roller 43 and the separation pad 44 may be made of normal rubber material. On the other hand, in the color image forming apparatus, after the color image was formed on one surface of the sheet, when the same sheet is re-supplied from the multi sheet supply portion, the feed roller 43 and the separation pad 44 may be made of silicone rubber. In this case, since the separation pad 44 made of silicone rubber has the greater close contact force than the pad made of normal rubber, the separation pad having the cut-in portions C1 is more effective.

Figure 4:
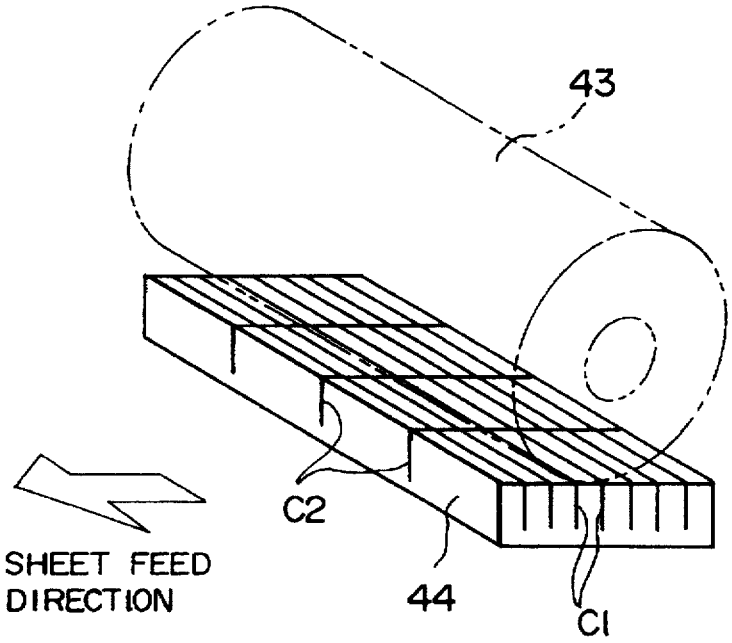
FIG. 4 is a perspective view showing a relation between a feed roller and a friction pad used in a sheet supply apparatus according to a second embodiment of the present invention.

Next, a second embodiment of the present invention will be explained with reference to FIG. 4. Incidentally, in this second embodiment, the fundamental construction of the sheet supply apparatus is substantially the same as that of the first embodiment, except for a construction of a separation pad. That is to say, in the first embodiment, while the cut-in portions C1 formed in the separation pad 44 extended along the direction perpendicular to the sheet feed direction, according to the second embodiment, in addition to such cut-in portions C1, additional cut-in portions C2 extending along the sheet feed direction are also formed in the separation pad.

When the cut-in portions C2 extending along the sheet feed direction are formed in the separation pad in this way, if there is a difference in close contact feature of the sheet between the sheet feed direction and the perpendicular direction due to the dispersion in the surface treatment of the sheet, since the difference in close contact feature of the sheet between the sheet feed direction and the perpendicular direction can be absorbed by the separation pad 44, the sheet can be separated and supplied more stably.

Incidentally, in the second embodiment, while an example that the cut-in portions C1 extending along the direction perpendicular to the sheet feed direction and the cut-in portions C2 extending along the sheet feed direction are formed in the separation pad was explained, the cut-in portions C1 and C2 may be inclined at a predetermined angle with respect to an up-and-down direction or a left-and-right direction.

Figure 5:
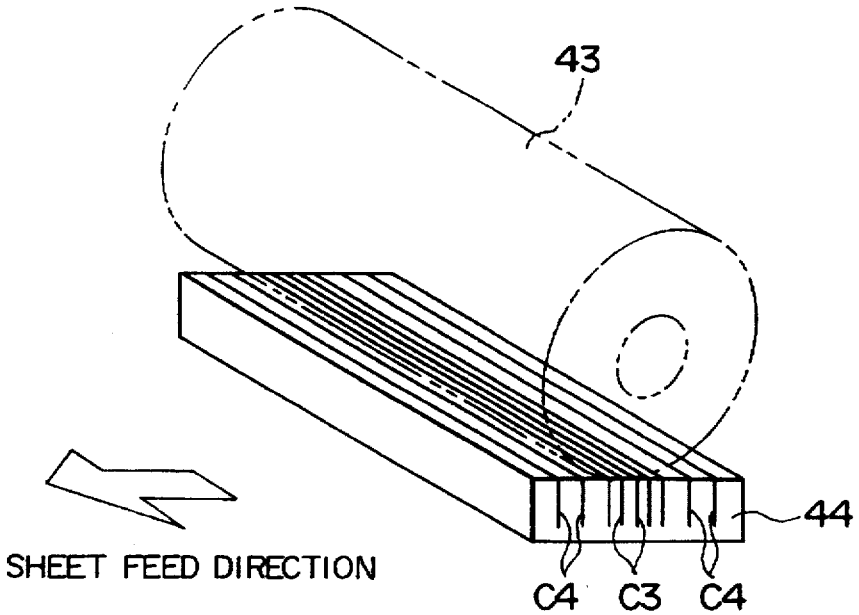
FIG. 5 is a perspective view showing a relation between a feed roller and a friction pad used in a sheet supply apparatus according to a third embodiment of the present invention.

Next, a third embodiment of the present invention will be explained with reference to FIG. 5. Incidentally, in this third embodiment, the fundamental construction of the sheet supply apparatus is substantially the same as that of the first embodiment, except for a construction of a separation pad.

In general, when the sheet is supplied, a range of the surface of the separation pad 44 which is actually contacted with the sheet S is limited. That is to say, only a nip between the feed roller 43 and the separation pad 44 or only a slightly larger area including such a nip is contacted with the sheet. In consideration of this fact, according to the third embodiment, regarding the separation pad, a distance between the adjacent cut-in portions C3 in the nip area and therearound is smaller than a distance between the adjacent cut-in portions C4 in the other areas.

With this arrangement, the close contact force between the sheet S and the separation pad 44 in the nip area is reduced, thereby further decreasing the load (in the sheet returning direction) acting on the feed roller 43. The distances between the adjacent cut-in portions may be gradually increased from the center of the nip to both end of the pad, or the distance between the adjacent cut-in portions in the nip area of the pad may be small and the distance between the adjacent cut-in portions in the other areas of the pad may be great. Further, as is in the second embodiment, the additional cut-in portions extending along the sheet feed direction may also be formed in the separation pad.

Incidentally, in the above-mentioned embodiments, the cut-in portions may be formed in the separation pad by partially cutting the surface of the separation pad in a plurality of positions, or the separation pad may be formed by attaching a plurality of upper plates to each other without any gap therebetween (In these cases, the same advantage can be obtained).

Further, by penetrating fine powder such as silicon powder or graphite powder into each cut-in portion, the close contact between the adjacent cut-in portions is prevented to permit the positive inclining movement of each section (between the cut-in portions). In the case where the fine powder is used, the close contact between the adjacent cut-in portions can always be prevented to always maintain the good separating ability for a long time regardless of the change in environment.

Next, a fourth embodiment of the present invention will be explained with reference to FIGS. 6A and 6B.

In the above-mentioned embodiments, while examples that the present invention is applied to the sheet supply apparatus having a separation pad 44 for separating the sheets S were explained, in the fourth embodiment, the present invention is applied to a sheet supply apparatus 50 having a so-called retard separation mechanism wherein the sheets S are separated one by one by using a reverse rotation roller.

Figure 6A:
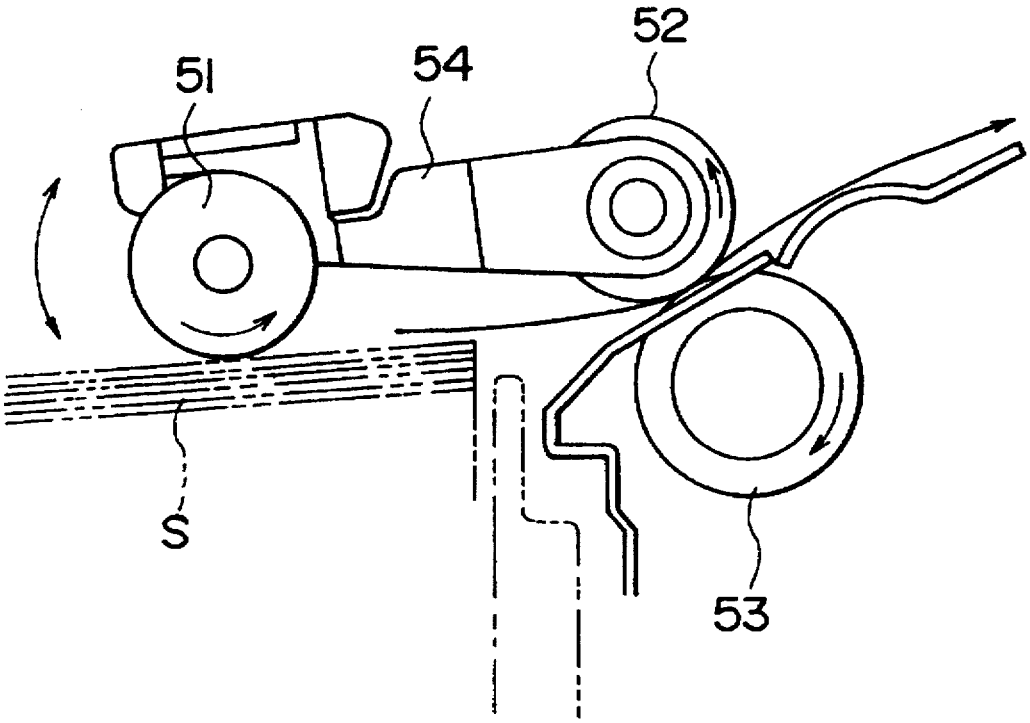
FIGS. 6A and 6B are views showing an entire construction of a fourth embodiment of the present invention.

As shown in FIG. 6A, the sheet supply apparatus 50 comprises a pick-up roller 51 adapted to abut against an upper surface of a sheet stack S to feed out the sheet(s) S, and a retard separation mechanism disposed at a downstream side of the pick-up roller and adapted to separate the sheets S supplied by the pick-up roller 51. This separation mechanism includes a feed roller (supply rotary member) 52 for rotated in the sheet feed direction to feed the sheet S, and a retard roller (friction member) 53 urged against the feed roller 52 and rotated in the sheet returning direction.

The pick-up roller 51 is supported by an arm 54 for swinging movement. When the pick-up roller abuts against the sheet S and is rotated in the sheet feed direction, the sheet(s) S are fed out. Further, a driving force is transmitted to the retard roller 53 through a torque limiter (not shown) so that, if torque acting on the retard roller 53 in the sheet feed direction exceeds a predetermined value, the retard roller is rotated idly. Accordingly, when a plurality of sheets enter between the feed roller 52 and the retard roller 53, the movements of the sheets near the reversely rotated retard roller 53 are successively stopped, and, when the single sheet is inserted between the feed roller 52 and the retard roller 53, the retard roller 53 is driven by the rotation of the feed roller 52 due to the presence of the torque limiter.

Figure 6B:
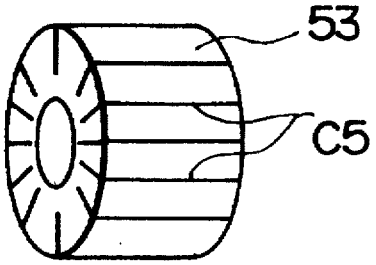

Explaining a construction of the retard roller 53 with reference to FIG. 6B, unlike to the above-mentioned separation pad 44, since the retard roller 44 is driven by the movement of the sheet (i.e. rotation of the feed roller 52) due to the presence of the torque limiter, sheets (such as OHP sheets) having high close contact feature can be separated and supplied relatively stably. However, in consideration of the separation and supply of various kinds of sheets, as shown in FIG. 6B, by forming cut-in portions C5 (extending along a longitudinal direction of the retard roller, i.e. extending along a direction perpendicular to the sheet feed direction) in a circumferential surface of the retard roller, a sheet separating and conveying ability of the retard roller can be further improved.

In the color image forming apparatus, since sheets to which silicone oil is adhered are frequently handles, the rollers are made of silicone rubber. Since the silicone rubber is apt to be closely contacted with the OHP sheet more than other rubber materials, by providing the cut-in portions C5, the close contact force can be decreased. Further, by providing the cut-in portions C5, the sheets to which silicone oil (mold releasing agent) is adhered can stably be separated to prevent the double feed of sheets by the friction force and elastic sheet returning ability of each sections of the roller. In addition, the excessive mold releasing agent such as the silicone oil can be absorbed or collected in the cut-in portions C5.

Figure 7:
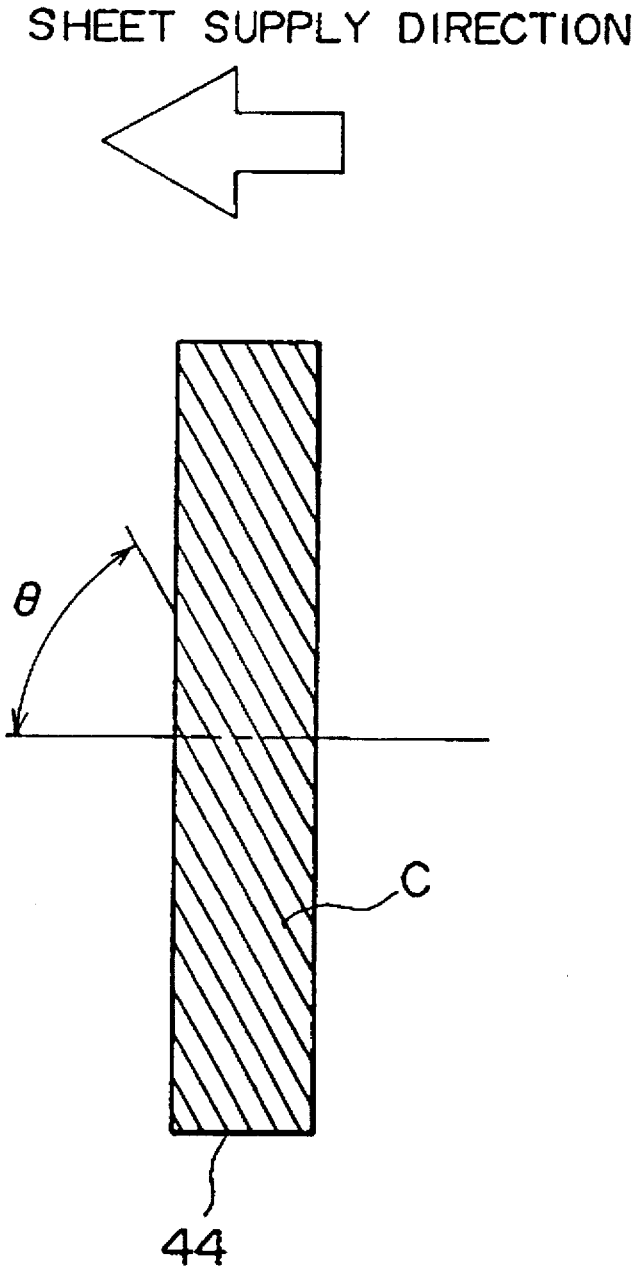
FIG. 7 is a plan view of a friction pad used in a sheet supply apparatus according to a fifth embodiment of the present invention.

Next, a fifth embodiment of the present invention will be explained with reference to FIG. 7. Incidentally, in this embodiment, the fundamental construction of the sheet supply apparatus is substantially the same as that of the first embodiment, except for a construction of a separation pad. FIG. 7 is a plan view of a separation pad 44 according to the fifth embodiment. As shown, cut-in portions C are formed in the separation pad at a predetermined angle θ with respect to a sheet supply (feed) direction.

In the case where the cut-in portions C1 extend along the direction perpendicular to the sheet feed direction as is in the first embodiment, for example, if burr is formed on a tip end of the sheet, it is feared that the burr is caught by any cut-in portion. However, in this fifth embodiment, since the cut-in portions C are inclined with respect to the sheet supply direction, if the burr is formed on the tip end of the sheet, because the burr is merely contacted with each cut-in portion only at a point (point contact), the occurrence of the poor conveyance can be greatly reduced in comparison with the cut-in portions extending along the direction perpendicular to the sheet feed direction.

The inclination angle θ of each cut-in portion C with respect to the sheet supply direction is preferably about 75 degrees or less in order to prevent the poor conveyance due to the burr obstruction, and, is preferably about 45 degrees or more in order to provide the good action of the cut-in portion (i.e. $75° \geqq \theta \geqq 45°$).

Incidentally, in this fifth embodiment, while an example that the inclined cut-in portions are formed in the separation pad 44 was explained, such cut-in portions may be formed in a retard roller (53) of a separation mechanism having a reverse rotation roller as is in the above-mentioned fourth embodiment.

Next, a sixth of the present invention will be explained with reference to FIGS. 8A and 8B. Incidentally, in this embodiment, the fundamental construction of the sheet supply apparatus is substantially the same as that of the first embodiment, except for a construction of a separation pad and a pad holder.

In this embodiment, a separation pad 44 having inclined cut-in portions C is urged or pressurized by a feed roller (not shown in FIGS. 8A and 8B) in a condition that the pad is mounted on a pad holder 45, each of the sections divided by the cut-in portions C is subjected to the urging force from the feed roller. In this condition, if the sheet apparatus is left as it is for a long time, the divided sections are adhered to each other to reduce the effect of the cut-in portions, thereby causing the poor conveyance of sheet.

Figure 8A:
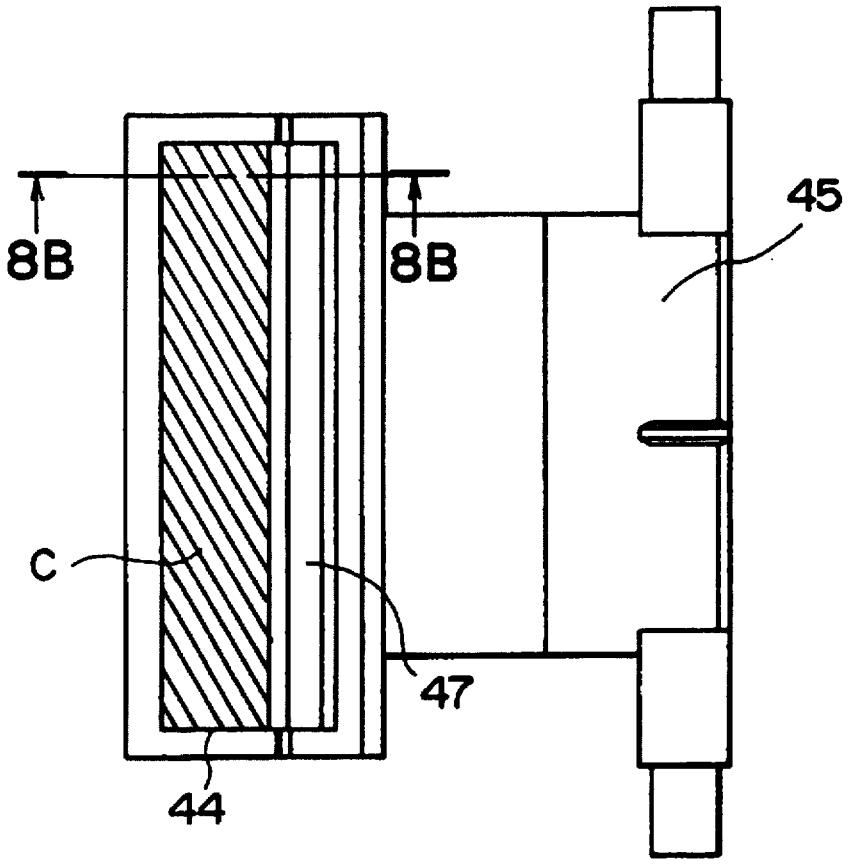
FIGS. 8A and 8B are a plan view and a sectional view of a friction pad used in a sheet supply apparatus according to a sixth embodiment of the present invention, respectively.
Figure 8B:
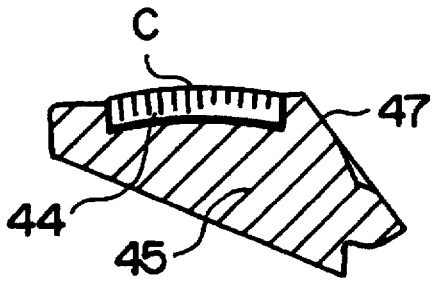

To avoid this, in this sixth embodiment, in order to reduce the contacting force between the adjacent sections, as shown in FIG. 8B, the separation pad 44 is mounted on the pad holder 45 in a convex form. This is achieved by forming a surface (of the pad holder 45) on which the separation pad 44 is mounted in a convex form.

With this arrangement, since each cut-in portion C tends to be slightly widened, even if the separation pad is left as it is for a long time in the condition that the separation pad is urged by the feed roller, the sections divided by the cut-in portions C are not adhered to each other, thereby always maintaining the effect of the cut-in portions C.

Incidentally, in this sixth embodiment, while an example that the cut-in portions C are inclined with respect to the sheet feed direction was explained, as is in the first embodiment, the cut-in portions may be formed in the separation pad along the direction perpendicular to the sheet feed direction.

In FIGS. 8A and 8B, a sliding guide 47 for guiding the tip end of the sheet toward the surface of the separation pad 44 is made of material having small friction resistance such as Myler, SUS or the like.

Figure 9:
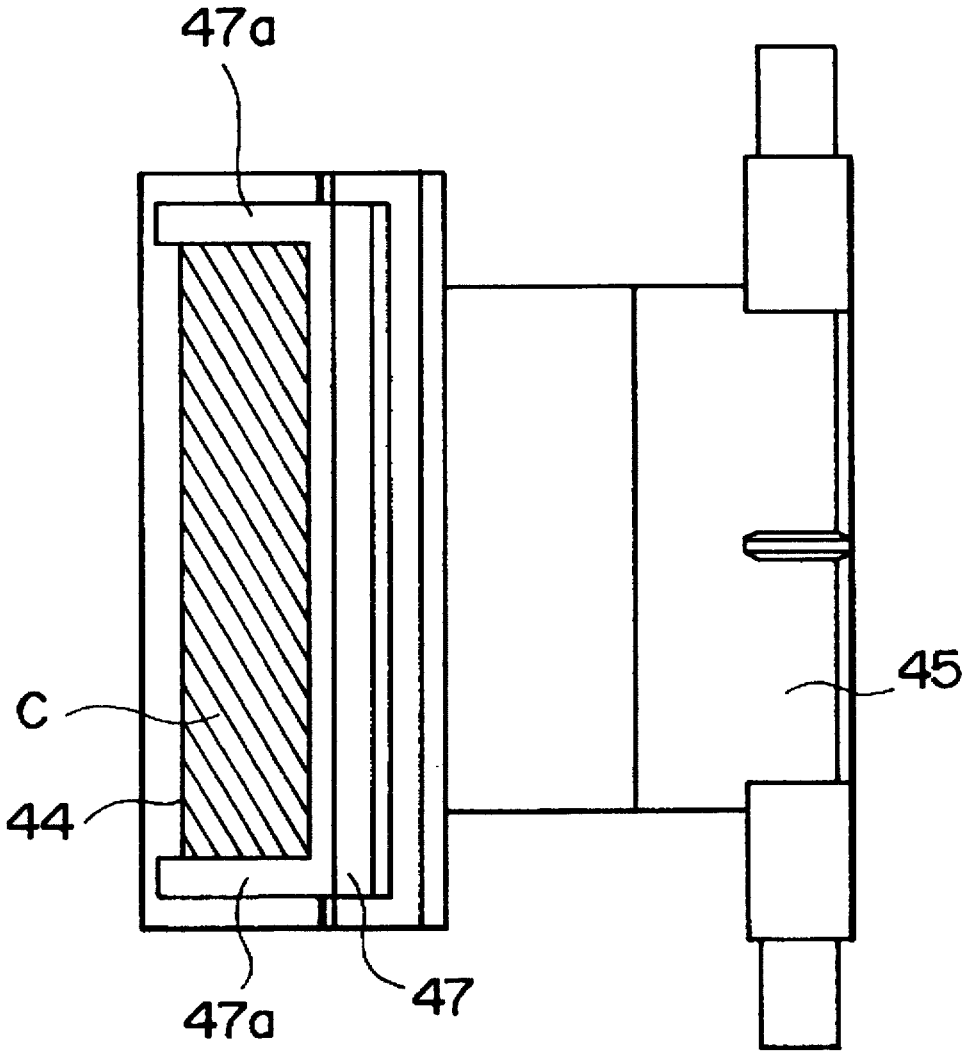
FIG. 9 is a plan view of a friction pad used in a sheet supply apparatus according to a seventh embodiment of the present invention.

Next, a seventh embodiment of the present invention will be explained with reference to FIG. 9. Incidentally, in this embodiment, the fundamental construction of the sheet supply apparatus is substantially the same as that of the fifth embodiment.

When the cut-in portions C of the separation pad 44 is inclined with respect to the sheet feed direction, the interference between the sheet S and the cut-in portions C can be reduced. To the contrary, however, at both ends of the separation pad 44, the sheet is apt to be caught by the cut-in portions. According to this seventh embodiment, in order to avoid the interference between the sheet S and the cut-in portions C at both ends of the separation pad 44, the both ends of the separation pad 44 are covered by the sliding guide 47.

That is to say, the sliding guide 47 is provided at its both ends with extensions 47*a* for covering the both ends of the separation pad 44. with this arrangement, the tip end of the sheet S is not caught by the cut-in portions due to the presence of the extensions of the sliding guide 47, thereby separating the sheets stably. Incidentally, in the seventh embodiment, while an example that the both ends of the separation pad 44 are covered by two extensions 47*a* of the sliding guide 47 was explained, only one end of the separation pad which is apt to catch the sheet may be covered by a single extension of the sliding guide.

Figure 10A:
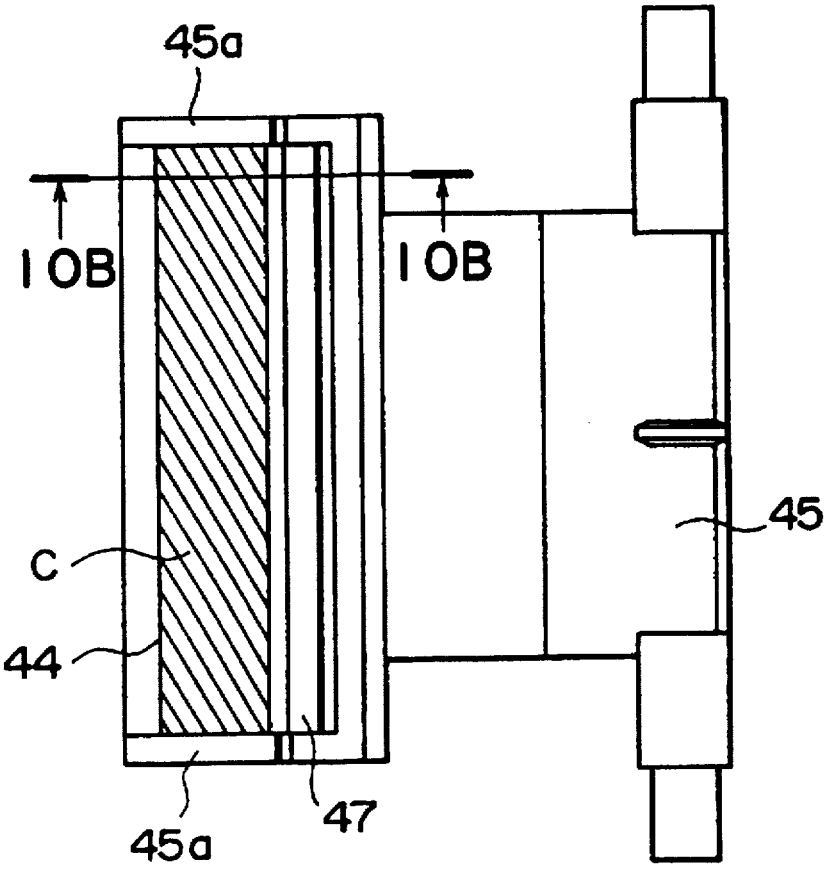
FIGS. 10A and 10B are a plan view and a sectional view of a friction pad used in a sheet supply apparatus according to a eighth embodiment of the present invention, respectively.
Figure 10B:
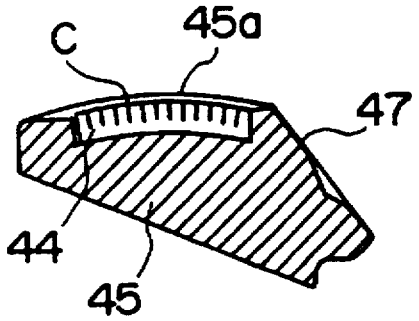

Further, in place of the fact that the both ends of the separation pad 44 are covered by the extensions 47*a* of the sliding guide 47, as shown in FIGS. 10A and 10B, protrusions 45*a* each having a height higher than the surface of the separation pad 44 may be formed on both end portions (adjacent to both ends of the separation pad) of the pad holder 45 so that the interference between the sheet and the cut-in portions of the separation pad is prevented.

Figure 11A:
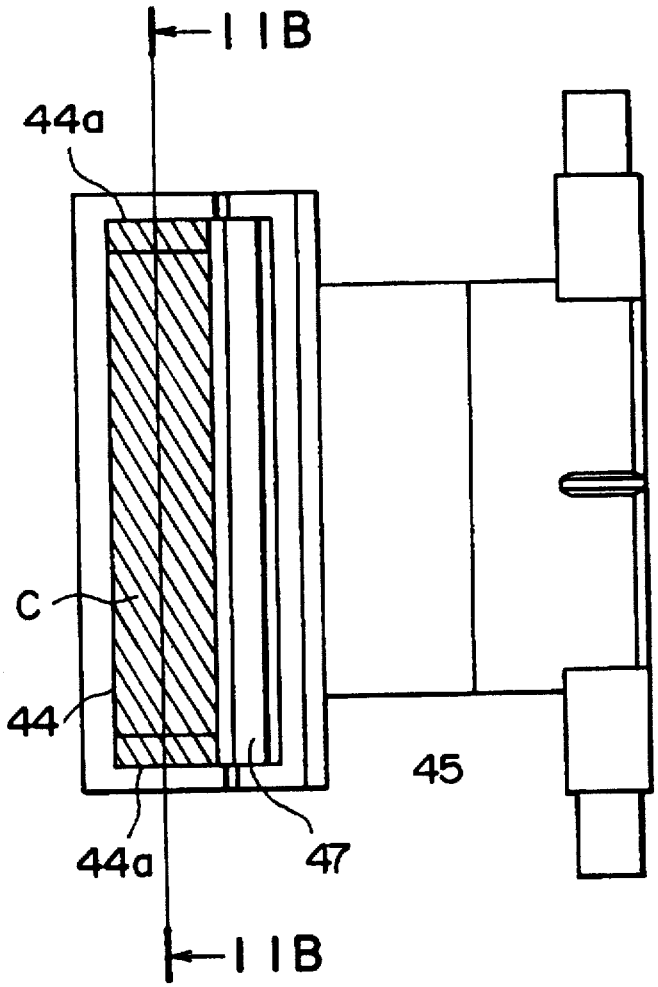
FIGS. 11A and 11B are a plan view and a sectional view of a friction pad used in a sheet supply apparatus according to a ninth embodiment of the present invention, respectively.
Figure 11B:
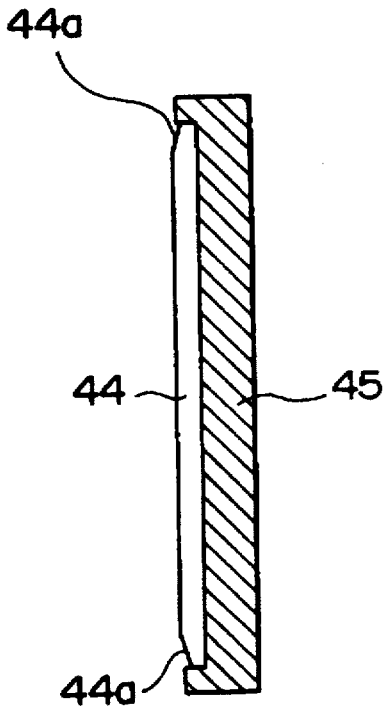

Alternatively, as shown in FIGS. 11A and 11B, both end portions 44*a* of the separation pad 44 may be chamfered to position the both ends of the pad below the both ends of the pad holder 45 so that the interference between the sheet and the cut-in portions of the separation pad is prevented.

In the above-mentioned embodiments, while an example that the present invention is applied to the color image forming apparatus was explained, the present invention is not limited to such an example, but can be applied to a sheet supply apparatus used with other image forming apparatuses such as a copying machine, a printer, a facsimile and the like.

As mentioned above, according to the present invention, by providing the cut-in portions in the friction member (for preventing the double feed of sheets) of the separation mechanism, regarding the sheets having high close contact feature, the friction force between the friction member and the sheet can be reduced to achieve the positive separation, and, regarding the sheets having low close contact feature, the positive separation can be achieved by the adequate friction force as is in the prior art. Thus, various kinds of sheets can stably be separated and supplied. Accordingly, the present invention provides a highly reliable sheet supply apparatus. Further, particularly when the friction member is made of silicone rubber to permit the both-face color copy, although the OHP sheet has high close contact force, even the OHP sheets can easily be separated positively, merely by forming the cut-in portions in the friction member.

In this way, according to the present invention, merely by forming the cut-in portions in the surface of the existing friction member, a reliable and cheap sheet supply apparatus can be obtained.

While the present invention has been described with respect to what is presently considered to be the preferred embodiments, it is to be understood that the invention is not limited to the disclosed embodiments. The present invention is intended to cover various modifications and equivalent arrangement included within the spirit and scope of the appended claims.

What is claimed is:

1. A sheet supply apparatus comprising:

a supply rotary means for feeding a sheet; and a friction member cooperating with said supply rotary means for separating the sheets one by one, by regulating feeding of the sheets other than the sheet to be separated in the feeding direction;

wherein a surface of the friction member with which the sheet is to be contacted has at least one cut-in portion.

2. A sheet supply apparatus according to claim 1, wherein said friction member comprises a separation pad urged against said supply rotary means for preventing the movement of the remaining sheets in the sheet feeding direction.

3. A sheet supply apparatus according to claim 2, wherein said separation pad is made of silicone rubber.

4. A sheet supply apparatus according to claim 1, wherein said friction member is a retard roller urged against the supply rotary means and rotated in a direction opposite to the sheet feed direction for preventing the movement of the remaining sheets in the sheet feed direction, and the cut-in portion is formed in an outer peripheral surface of said retard roller.

5. A sheet supply apparatus according to claim 4, wherein said retard roller is made of silicone rubber.

6. A sheet supply apparatus according to one of claims 1 to 5, wherein the cut-in portion is formed in said friction member along a direction perpendicular to the sheet feed direction.

7. A sheet supply apparatus according to one of claims 1 to 5, wherein the cut-in portions are formed in said friction member along a direction perpendicular to the sheet feed direction and along a direction parallel to the sheet feed direction.

8. A sheet supply apparatus according to claim 2, wherein a distance between the cut-in portions near a nip between said supply rotary means and said separation pad is smaller than the distance between the cut-in portions in the other areas.

9. A sheet supply apparatus according to claim 1, wherein said friction member is formed by assembling a plurality of pieces to each other without any gap therebetween to provide the cut-in portions.

10. A sheet supply apparatus according to claim 1, wherein fine powder for preventing adhesion of sections between the cut-in portions is received in the cut-in portion.

11. A sheet supply apparatus according to claim 2, wherein said separation pad is mounted on a pad holder in a convex form.

12. A sheet supply apparatus comprising:

a supply rotary means for feeding a sheet; and a friction member cooperating with the supply rotary means for separating the sheets one by one, by regulating feeding of the sheets other than the sheet to be separated in the feeding direction;

wherein a surface of the friction member with which the sheet is to be contacted is divided into a plurality of sections which are contacted with each other without any gap.

13. A sheet supply apparatus according to claim 12, wherein said friction member comprises a separation pad urged against said supply rotary means for preventing the movement of the remaining sheets in the sheet feed direction.

14. A sheet supply apparatus according to claim 12, wherein said friction member is a retard roller urged against the supply rotary means and rotated in a direction opposite to the sheet feed direction for preventing the movement of the remaining sheets in the sheet feed direction.

15. A sheet supply apparatus comprising:

a supply rotary means for feeding a sheet; and a friction member cooperating with the supply rotary means for separating the sheets one by one, by regulating feeding of the sheets other than the sheet to be separated in the feeding direction;

wherein a surface of the friction member with which the sheet is to be contacted has at least one cut-in portion inclined at a predetermined angle with respect to the sheet feed direction of said supply rotary means.

16. A sheet supply apparatus according to claim 15, wherein said friction member is a separation pad urged against said supply rotary means for preventing the movement of the remaining sheets in the sheet feed direction, and said separation pad has the cut-in portion.

17. A sheet supply apparatus according to claim 16, wherein said separation pad is mounted on a pad holder so that a surface thereof is convex.

18. A sheet supply apparatus according to claim 16, wherein said predetermined angle ($\theta$) is smaller than 75 degrees and greater than 45 degrees.

19. A sheet supply apparatus according to one of claims 16 to 18, wherein a sliding guide for guiding a tip end of the sheet toward said separation pad is provided on a pad holder for supporting said separation pad, and extensions for covering both ends of said separation pad are provided on said sliding guide.

20. A sheet supply apparatus according to one of claims 16 to 18, wherein protrusions having heights higher than the surface of said separation pad are provided on a pad holder for supporting said separation pad, near both ends of said separation pad.

21. A sheet supply apparatus according to one of claims 16 to 18, further comprising a pad holder for supporting said separation pad, and both end portions of said separation pad are chamfered to be lower than said pad holder.

22. A sheet supply apparatus according to claim 15, wherein said friction member is a retard roller urged against the supply rotary means and rotated in a direction opposite to the sheet feed direction for preventing the movement of the remaining sheets in the sheet feed direction, and the cut-in portions is formed in an outer peripheral surface of said retard roller.

23. An image forming apparatus comprising:

a supply rotary means for feeding a sheet;

a friction member cooperating with the supply rotary means for separating the sheets one by one, by regulating feeding of the sheets other than the sheet to be separated in the feeding direction; and an image forming means for forming an image on the sheet separated by said friction member;

wherein a surface of the friction member with which the sheet is to be contacted has at least one cut-in portion.

24. An image forming apparatus comprising:

a supply rotary means for feeding a sheet;

a friction member cooperating with said supply rotary means for separating the sheets one by one, by regulating feeding of the sheets other than the sheet to be separated in the feeding direction; and an image forming means for forming an image on the sheet separated by said friction member;

wherein a surface of the friction member with which the sheet is to be contacted is divided into a plurality of sections which are contacted with each other without any gap.

25. An image forming apparatus comprising:

a supply rotary means for feeding a sheet;

a friction member cooperating with said supply rotary means for separating the sheets one by one, by regulating feeding of the sheets other than the sheet to be separated in the feeding direction; and an image forming means for forming an image on the sheet separated by said friction member;

wherein a surface of the friction member with which the sheet is to be contacted has at least one cut-in portion inclined at a predetermined angle with respect to the sheet feed direction of said supply rotary means.

26. A sheet supply apparatus according to claim 13, wherein said separation pad is made of silicone rubber.

27. A sheet supply apparatus according to claim 16, wherein said separation pad is made of silicone rubber.

* * * * *

UNITED STATES PATENT AND TRADEMARK OFFICE

CERTIFICATE OF CORRECTION

PATENT NO. : 5,697,604
DATED : December 16, 1997
INVENTOR(S) : Akinori TANAKA

It is certified that error appears in the above-indentified patent and that said Letters Patent is hereby corrected as shown below:

Column 2, lines 24 and 29, delete "do so", each occurrence, and insert therefor --done--.

Column 3, line 66, delete "a" and insert therefor --an--.

Column 6, line 20, delete "to".

Signed and Sealed this

Twenty-third Day of June, 1998

Bruce Lehman

*Attest:*

BRUCE LEHMAN

*Attesting Officer*

*Commissioner of Patents and Trademarks*